US010791773B2

(12) United States Patent
Hirakubo

(10) Patent No.: US 10,791,773 B2
(45) Date of Patent: Oct. 6, 2020

(54) BRASSIERE

(71) Applicant: Gold Flag Ltd., Higashiosaka-shi, Osaka (JP)

(72) Inventor: Akiyo Hirakubo, Higashiosaka (JP)

(73) Assignee: GOLD FLAG LTD., Osaka (JP)

( * ) Notice: Subject to any disclaimer, the term of this patent is extended or adjusted under 35 U.S.C. 154(b) by 0 days.

(21) Appl. No.: 15/319,447

(22) PCT Filed: Jun. 18, 2014

(86) PCT No.: PCT/JP2014/003277
§ 371 (c)(1),
(2) Date: Dec. 16, 2016

(87) PCT Pub. No.: WO2015/193932
PCT Pub. Date: Dec. 23, 2015

(65) Prior Publication Data

US 2017/0150759 A1 Jun. 1, 2017

(51) Int. Cl.
*A41C 3/10* (2006.01)
*A41C 3/14* (2006.01)

(52) U.S. Cl.
CPC ..... *A41C 3/10* (2013.01); *A41C 3/144* (2013.01)

(58) Field of Classification Search
CPC ..... A41C 3/144; A41C 3/148; A41C 3/14; A41C 3/10
(Continued)

(56) References Cited

U.S. PATENT DOCUMENTS 2,661,470 A * 12/1953 Day ..... A41C 3/148 2/67
2,875,764 A * 3/1959 Benson ..... A41C 3/10 450/53
(Continued)

FOREIGN PATENT DOCUMENTS

CH 271095 A * 10/1950 ..... A41C 3/10
CN 101164460 A 4/2008
(Continued)

OTHER PUBLICATIONS

International Search Report dated Aug. 19, 2014 for PCT/JP2014/003277 and English translation.
(Continued)

*Primary Examiner* — Gloria M Hale
*Assistant Examiner* — Brieanna Szafran
(74) *Attorney, Agent, or Firm* — Lucas & Mercanti, LLP

(57) ABSTRACT

The present invention provides a brassiere that can create not only a cleavage of breasts but also a beautiful decollete in a neckline area by naturally pushing up the breasts, even when the user is a person whose breasts including flab have little volume, or an elderly person whose breasts have no volume particularly in an area near the stomach and moreover are droopy. This brassiere includes: a pair of cups (20) covering breasts (B); a front panel (31) to which the cups (20) are attached; side panels (40) extending from underarm portions of the front panel (31); and straps (50) provided from upper edges of the respective cups (20) to the side panels (40). A substantially triangular pad (70) is disposed to be overlapped with a substantially triangular part (S) that is surrounded by a rising portion (28) from a stomach part (20*a*) of each cup (20) and a horizontal edge portion (29) from the stomach part (20*a*). Two sides (70*b*) and (70*c*) of
(Continued)

the triangular pad (70) are sewed to the rising portion (28) and the horizontal edge portion (29), respectively.

2 Claims, 9 Drawing Sheets

(58) Field of Classification Search
USPC ..... 450/54–55
See application file for complete search history.

(56) References Cited

U.S. PATENT DOCUMENTS 3,099,839 A * 8/1963 Kester ..... A41C 3/148 623/7
3,221,748 A * 12/1965 Glasser ..... A41C 3/10 450/56
3,247,853 A * 4/1966 Sloate ..... A41C 3/10 450/55
3,568,681 A * 3/1971 Comollo ..... A41C 3/0092 450/54
3,834,397 A * 9/1974 Birch ..... A41C 3/10 450/56
5,098,330 A * 3/1992 Greenberg ..... A41C 3/10 450/31
5,334,082 A * 8/1994 Barker ..... A41C 3/10 2/247
5,868,601 A * 2/1999 Kelemencky ..... A41C 3/0028 2/73
6,156,065 A * 12/2000 Eaton ..... A41C 3/0071 450/54
6,165,047 A * 12/2000 Scott ..... A41C 3/0028 450/1
7,081,034 B1 * 7/2006 Zoellner ..... A41C 3/04 2/104
8,277,276 B2 * 10/2012 Waitz ..... A41C 3/10 450/39
8,657,643 B2 * 2/2014 Perez ..... A41C 3/04 450/36
9,737,096 B2 * 8/2017 Hirakubo ..... A41C 3/14
2007/0049163 A1 * 3/2007 Lin ..... A41C 3/10 450/54
2008/0139085 A1 * 6/2008 Wu ..... A41C 3/144 450/39
2008/0176485 A1 * 7/2008 Linkon ..... A41C 3/10 450/57
2009/0104845 A1 * 4/2009 Pintor ..... A41C 3/0035 450/31
2011/0237157 A1 * 9/2011 Scott ..... A41C 3/0028 450/41
2014/0302745 A1 * 10/2014 Golubovic ..... A61F 13/15 450/1
2015/0320122 A1 * 11/2015 Hirakubo ..... A41C 3/12 450/55
2017/0296394 A1 * 10/2017 Clarke ..... A61L 15/26

FOREIGN PATENT DOCUMENTS

CN 102726844 A 10/2012
FR 958747 A * 3/1950 ..... A41C 3/10
FR 1400020 A * 5/1965 ..... A41C 3/10
JP 2003183906 A 7/2003
JP 2003221706 A 8/2003
JP 2007070753 A 3/2007
JP 2008101284 A 5/2008
JP 4943965 B2 3/2012
JP 5520421 B1 6/2014
WO WO-2015064415 A1 * 5/2015 ..... A41C 3/14

OTHER PUBLICATIONS

Office Action dated Sep. 13, 2017 from corresponding Chinese Patent Application No. CN 201480079969.0.

* cited by examiner

[FIG. 1]
(a)
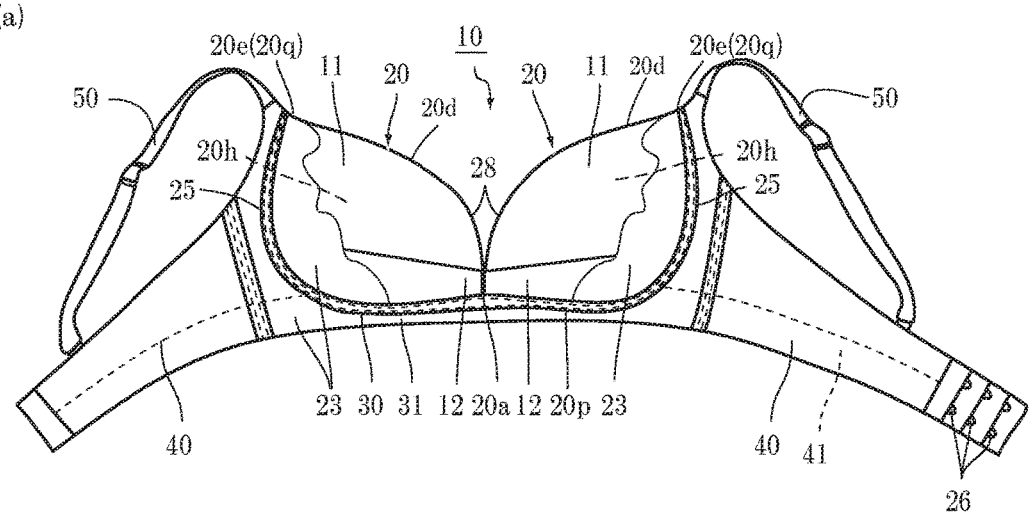
(b)
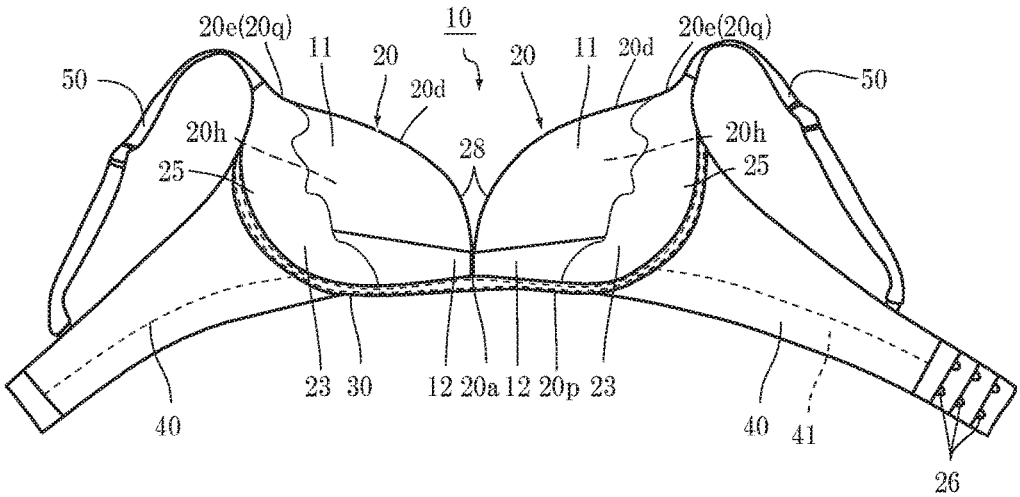

[FIG. 2]
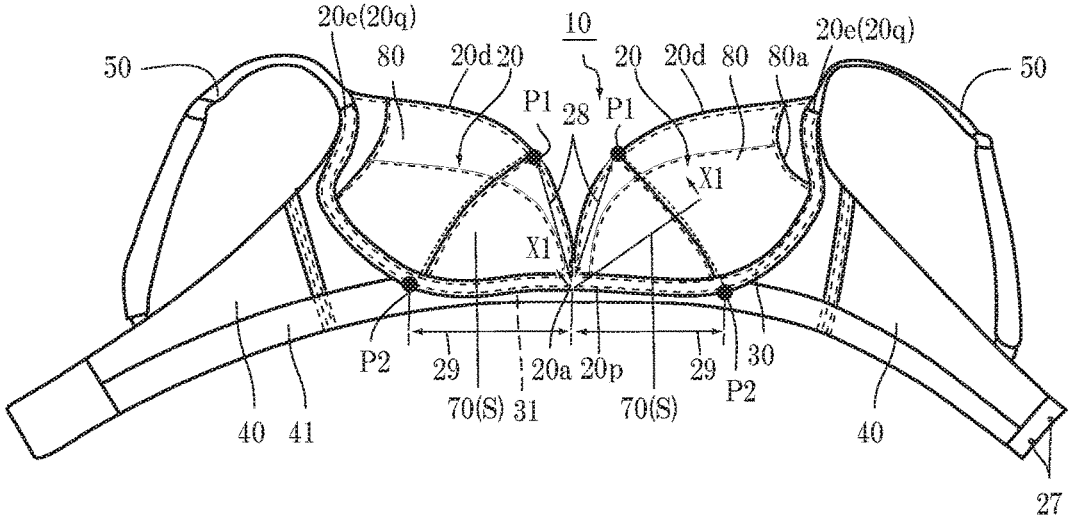

[FIG. 3]
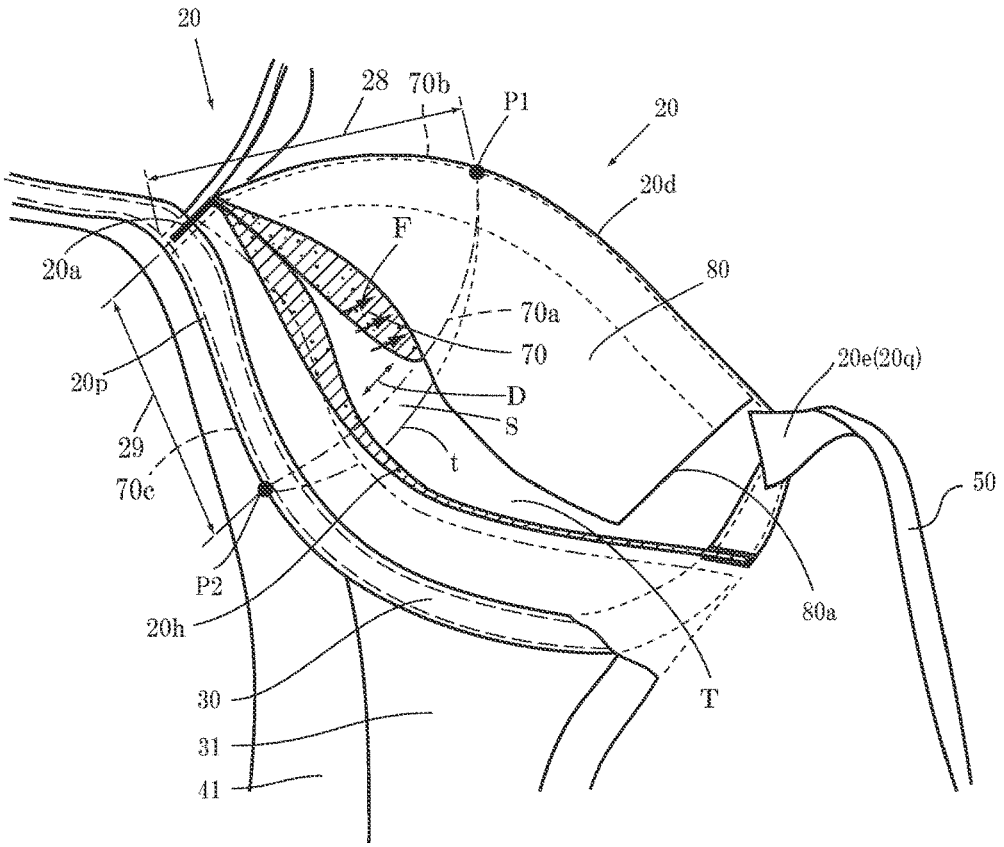
[FIG. 4]
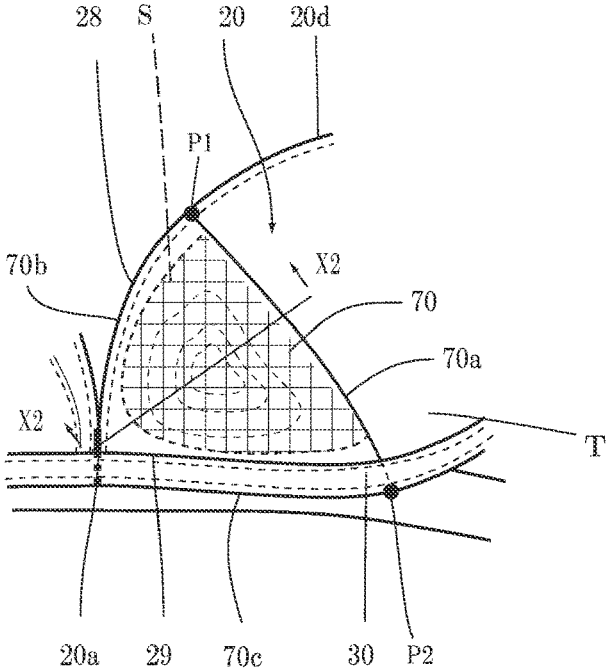

[FIG. 5]
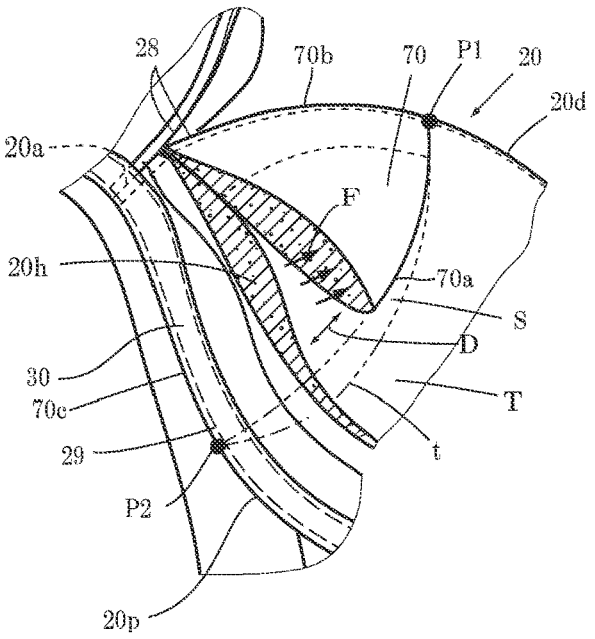
[FIG. 6]
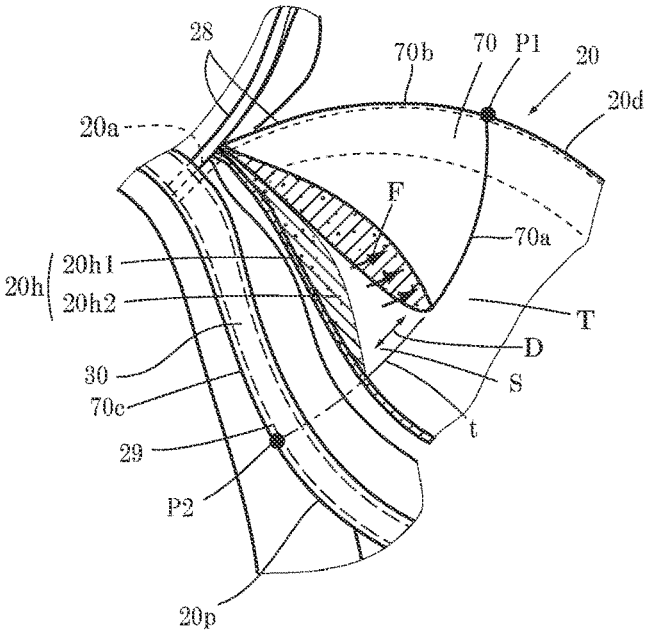

[FIG. 7]
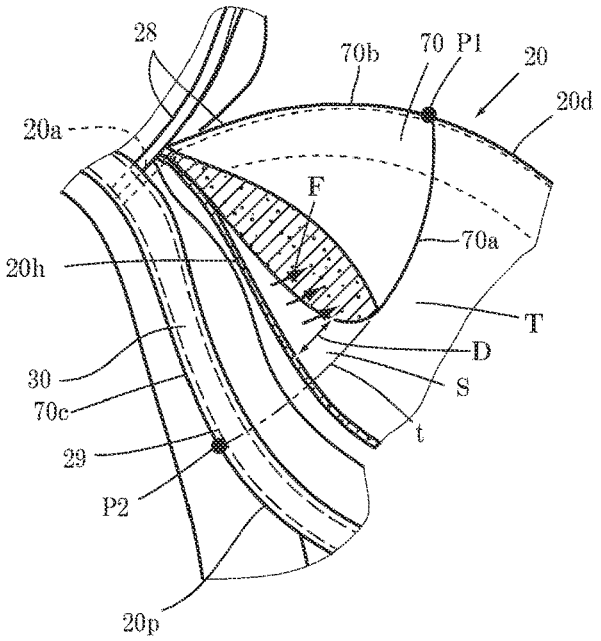
[FIG. 8]
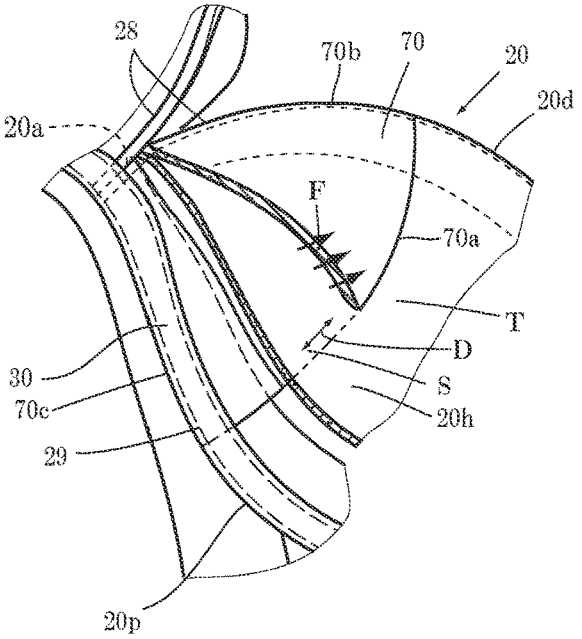

[FIG. 9]
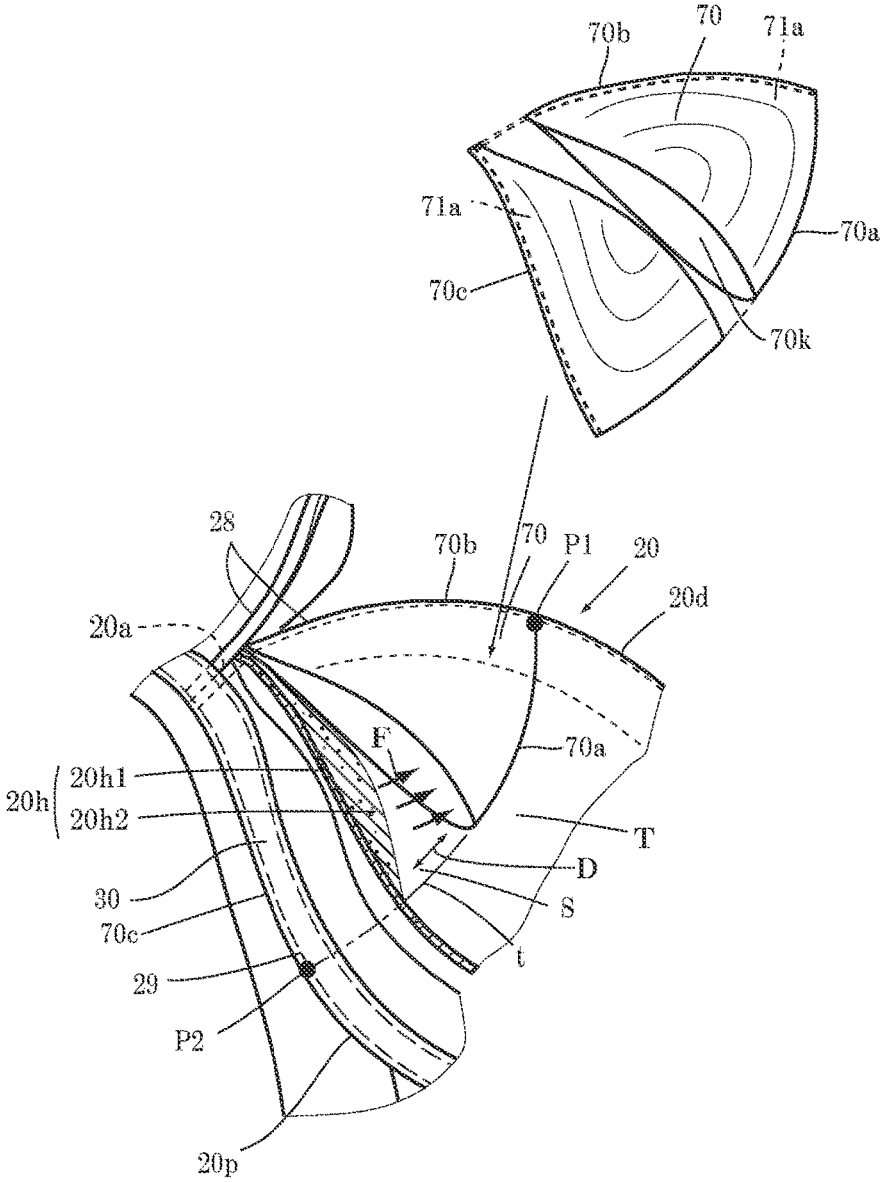

[FIG. 10]
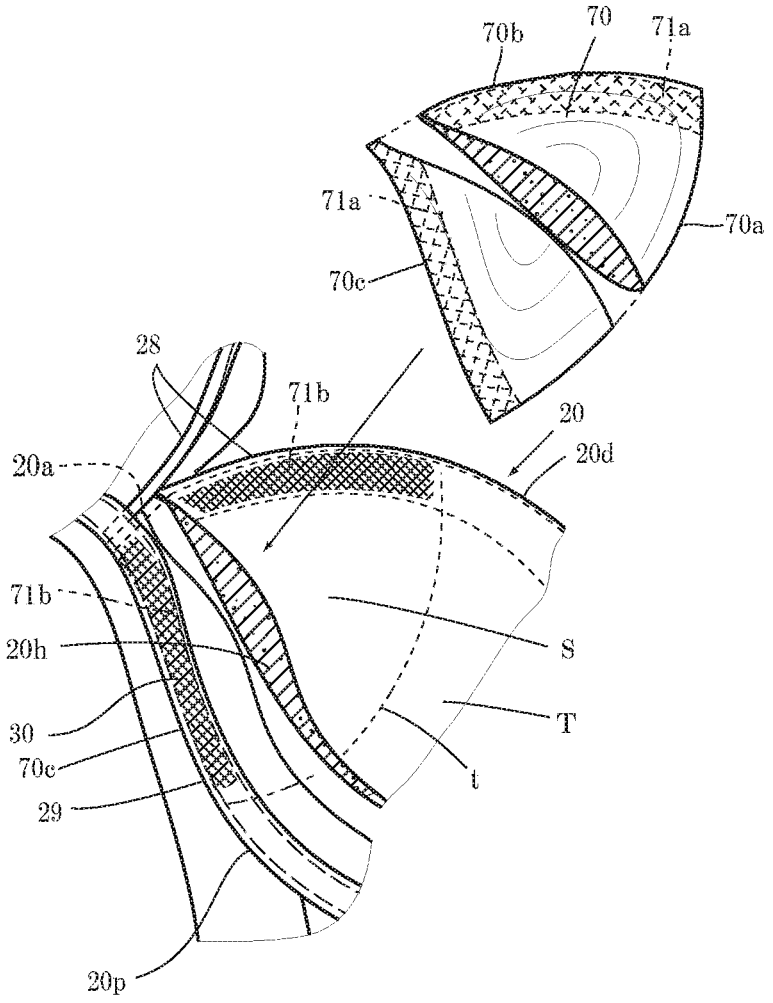

[FIG. 11]
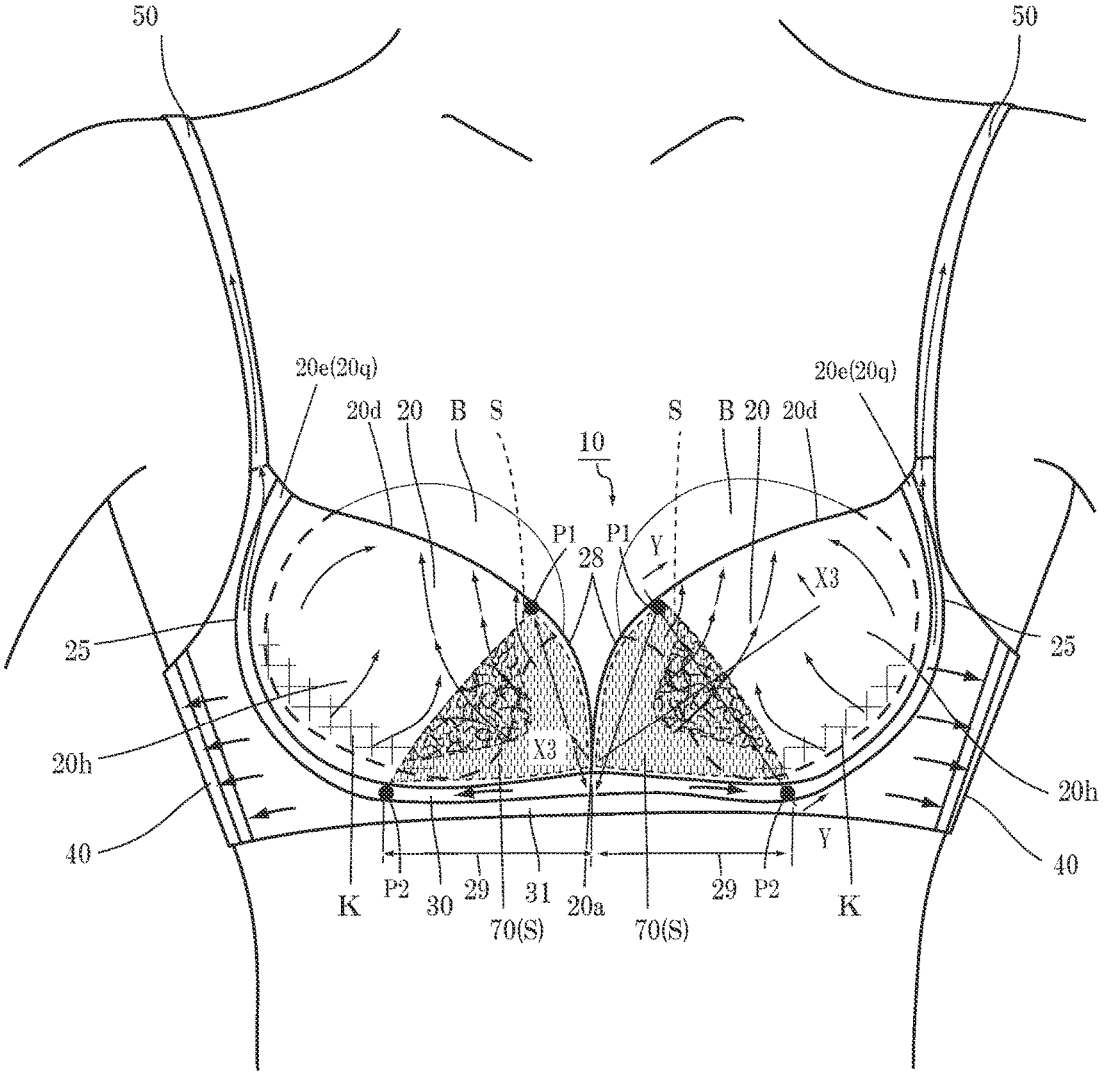

[FIG. 12]
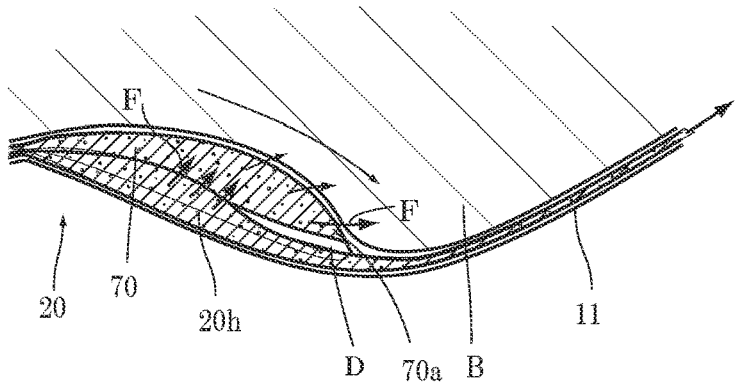
[FIG. 13]
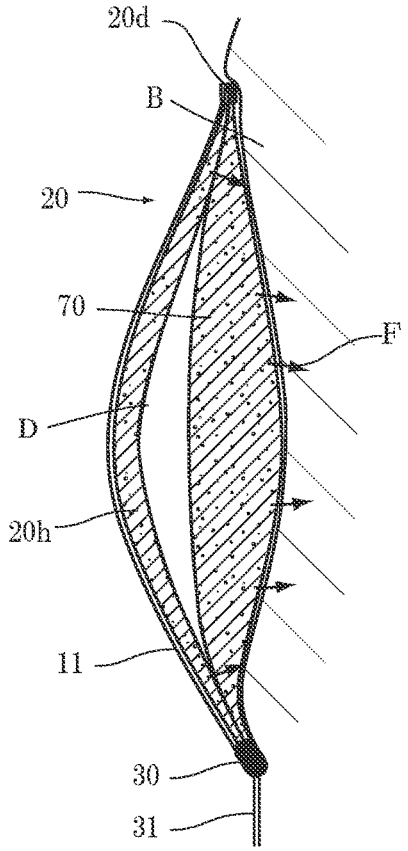

BRASSIERE

CROSS REFERENCE TO RELATED APPLICATION

This Application is a 371 of PCT/JP2014/003277 filed on Jun. 18, 2014, application which is incorporated herein by reference.

TECHNICAL FIELD

The present invention relates to a brassiere that can stably create an attractive cleavage and a voluminous beautiful decollete between, in particular, elderly woman's breasts or poor breasts.

BACKGROUND ART

There have conventionally been proposed brassieres that have a function of keeping the shape of breasts and a shape-correcting function of beautifully wrapping breasts with metal wires or the like (see Patent Literature 1, for example).

However, it has recently come into fashion that, when a user wears a brassiere, the brassiere slightly pulls up breasts accommodated in cups by means of the cups and creates a cleavage due to two spherical breasts between the cups, thereby forming a beautiful bust line. However, it has been pointed out that the cups being pulled up cause the metal wires to come into strong contact with the lower portions of the breasts, and the user feels uncomfortable if she wears the brassiere for a long period of time.

Therefore, there have been elaborately developed brassieres whose cups themselves are improved such that an attractive cleavage appears and simultaneously the cups have no wires. As an example of such an improved cup, there has been a proposed cup in which a total of three panels, i.e., an upper panel, a lower panel, and a sternum-side panel that form the cup, are sewed together to be integrated. Accordingly, when the brassiere slightly pulls up the breasts accommodated in the cups by means of the cups, the somewhat voluminous breasts including flab that have been inwardly gathered are received by the sternum-side panels so as not to protrude to the sternum side, thereby to create a cleavage between the cups. Thus, a beautiful bust line is formed (see Patent Literature 2, for example).

However, the volume of breasts varies widely. Therefore, the brassiere disclosed in Patent Literature 2 has been improved to provide a brassiere that allows less voluminous breasts to emphasize the bust line (see Patent Literature 3). The brassiere disclosed in Patent Literature 3 adopts cups each obtained by molding a foam textile into a cup shape. Each cup is composed of an upper breast holding face part that covers an upper portion of a breast and has an underarm-side end portion to which a strap is attached, a lower breast holding face part that covers a lower portion of the breast, and a sternum-side breast holding face part that covers a sternum-side portion of the breast. A rib is formed on an inner face of the sternum-side breast holding face part. The breast (including flab gathered from the underarm and the back toward the breast side) accommodated in each cap by being pulled up with the strap is pushed toward the rib. Then, the breast is pushed against a wall of an inner peripheral face of the rib and further pushed up toward the sternum side, thereby forming a beautiful decollete in the neckline area.

CITATION LIST

Patent Literature

[PTL 1] Japanese Laid-Open Patent Publication No. 2007-70753

[PTL 2] Japanese Patent No. 4943965

[PTL 3] Japanese Patent No. 5520421

SUMMARY OF INVENTION

Technical Problem

The brassiere disclosed in Patent Literature 3 is quite effective when the breasts including flab are somewhat voluminous, as described above. However, since the rib is formed integrally with the inner face of the sternum-side breast holding face part of the cup, it is only possible to lift up the breast pushed toward the rib by passively changing the direction of the breast upward. Further, when the user is an elderly person or a person whose breasts including flab have little volume, the volume to be pushed up by the wall of the inner peripheral face of the rib hardly exists, and therefore, the brassiere disclosed in Patent Literature 3 is not effective in this case.

An object of the present invention is to provide a brassiere that can create not only a cleavage of breasts but also a beautiful decollete in the neckline area by naturally pushing up the breasts, even when the user is a person whose breasts including flab have little volume, or an elderly person whose breasts have no volume particularly in an area near the stomach between the breasts and moreover are droopy.

Solution to Problem

The invention according to one embodiment of the present invention is a brassiere 10 including:

a pair of right and left cups 20 covering breasts B;

side panels 40 extending from underarm portions of the respective cups 20; and straps 50 provided from upper edges of the respective cups 20 to the side panels 40, wherein in each of the right and left cups 20, a substantially triangular pad 70 is disposed to be overlapped with a substantially triangular part S that is surrounded by a rising portion 28 of an upper side 20*d* of the cup 20 and a horizontal edge portion 29 of a lower side 20*p* of the cup 20, the rising portion 28 curving upward from a stomach part 20*a* at which the right and left cups 20 abut, and the horizontal edge portion 29 extending in a horizontal direction from the stomach part 20*a*, and two sides 70*b*, 70*c* of the triangular pad 70 are fitted to the rising portion 28 and the horizontal edge portion 29, respectively, while a remaining one side 70*a* of the triangular pad 70 is opened so as to be separated from an inner face of the cup 20.

The invention disclosed in claim 2 according to one embodiment of the present invention is a brassiere 10 including:

a pair of right and left cups 20 covering breasts B;

a front panel 31 to which the cups 20 are attached;

side panels 40 extending from underarm portions of the front panel 31; and straps 50 provided from upper edges of the respective cups 20 to the side panels 40, wherein in each of the right and left cups 20, a substantially triangular pad 70 is disposed to be overlapped with a substantially triangular part S that is surrounded by a rising portion 28 of an upper side 20*d* of the cup 20 and a horizontal edge portion 29 of a lower side 20*p* of the cup 20, the rising portion 28 curving upward from a stomach part 20*a* at which the right and left cups 20 abut, and the horizontal edge portion 29 extending in a horizontal direction from the stomach part 20*a*, and two sides 70*b*, 70*c* of the triangular pad 70 are fitted to the rising portion 28 and the horizontal edge portion 29, respectively, while a remaining one side 70*a* of the triangular pad 70 is opened so as to be separated from an inner face of the cup 20.

According to a further embodiment, the substantially triangular part S surrounded by the rising portion 28 of the upper side 20*d* of each of the right and left cups 20 and the horizontal edge portion 29 of the lower side 20*p* of the cup 20 extending from a lower edge of the stomach part 20*a* is formed to be thicker than a remaining part T of the cup 20.

According to another embodiment, the triangular pad 70 is a cushion-like pad that is made of a soft foamed resin or formed in a soft bag shape, and has a thickness that is small at the fitted two sides 70*b* and 70*c* and gradually increases toward a center portion thereof.

According to another embodiment, a pocket 80 for accommodating an auxiliary pad is further provided so as to cover the inner side of each cup 20, and the triangular pad 70 is fitted to a portion, of the pocket 80, corresponding to the substantially triangular part S of the cup 20.

According to another embodiment, the two sides 70*b*, 70*c* of the triangular pad 70 are fitted by means of hook and loop fasteners 71*a*, 71*b*.

Advantageous Effects of Invention

According to the embodiments of the invention described above, on the inner side of the cup 20 hemispherically swelling outward, the substantially triangular pad 70 is disposed to be overlapped with the substantially triangular part S surrounded by the rising portion 28 and the horizontal edge portion 29 that form a V shape, and the two sides 70*b*, 70*c* of the triangular pad 70 are fitted to the rising portion 28 and the horizontal edge portion 29, respectively, of the substantially triangular part S of the cup 20, while the remaining one side (open side 70*a*) of the triangular pad 70 is opened so as to be separated from the inner face of the cup 20. Therefore, when the brassiere 10 is not worn, the open side 70*a* and its adjacent portion separate from the inner face of the cup 20, and swell and rise in the direction opposite to the cup 20.

When a user wears the brassiere 10, the triangular pad 70 separated from the inner face of each cup 20, particularly the open side 70*a* and its adjacent portion (hatched portion in FIG. 4), fills a stomach area between less voluminous breasts B, and a swelling force F of the triangular pad 70 in the direction opposite to the cup 20 actively pushes the greater part of the breast B in this portion to the outside of the substantially triangular part S in the cup 20 as shown in FIGS. 12 to 13, whereby the volume of the entire breasts B is increased. When the side edges 25 of the cups 20 are pulled up by the straps 50 with the stomach part 20*a* in the center, the breasts B that appear more voluminous are pulled up by the lower side 20*p* of the cup 20, whereby a beautiful decollete is created in the neckline area.

In one embodiment described above, the substantially triangular part S of the cup 20 is formed to be thicker than the remaining part T of the cup 20. Therefore, the triangular pad 70 is pushed out by this thick part S, whereby further increase in volume of breasts is achieved and creation of a decollete is facilitated by the synergy effect with the swelling force F of the triangular pad 70.

In one embodiment described above, the triangular pad 70 is a cushion-like pad that is made of a soft foamed resin or formed in a soft bag shape, and has a thickness that is small at the fitted two sides 70*b* and 70*c* and gradually increases toward the center portion thereof. Therefore, when the user wears the brassiere 10, the thick center portion of the triangular pad 70 is pushed by the inner face of the cup 20 toward the breast B side, thereby promoting the volume increasing effect and the decollete creating effect.

In the embodiment in which the pocket 80 is further provided, insufficient breast volume can be compensated for by inserting the auxiliary pad separately prepared according to need into the pocket 80.

In the embodiment in which the hook and loop fasteners 71*a*, 71*b* are provided, the user can attach/detach the triangular pad 70 to/from the two sides 70*b*, 70*c* of the cup 20. When multiple types of triangular pads 70 are prepared, the user can use an optimum triangular pad 70.

BRIEF DESCRIPTION OF DRAWINGS

In FIG. 1, (a) is a front view showing a brassiere according to the present invention, and (b) is a front view showing another brassiere according to the present invention.

FIG. 2 is a rear view showing the brassiere according to the present invention.

FIG. 3 is an enlarged perspective view including a cross section taken along a line X1-X1 shown in FIG. 2.

FIG. 4 is a rear view of a main part in the case where no pocket is provided.

FIG. 5 is an enlarged perspective view including a cross section taken along a line X2-X2 shown in FIG. 4.

FIG. 6 is a partially cross-sectional enlarged perspective view in the case where a cup body shown in FIG. 5 is composed of two members.

FIG. 7 is a partially cross-sectional enlarged perspective view in which the entire cup body shown in FIG. 5 is formed to have a uniform thickness, and a thicker triangular pad is provided.

FIG. 8 is a partially cross-sectional enlarged perspective view in the case where the entire cup body and the triangular pad shown in FIG. 7 are each formed to have a uniform thickness.

FIG. 9 is a partially cross-sectional enlarged perspective view in which the triangular pad shown in FIG. 6 is formed in a soft bag shape.

FIG. 10 a partially cross-sectional enlarged perspective view in which the triangular pad shown in FIG. 5 is provided to be attachable and detachable.

FIG. 11 is a front view showing the state where the brassiere according to the present invention is worn.

FIG. 12 is an enlarged perspective view including a cross section taken along a line X3-X3 shown in FIG. 11.

FIG. 13 is an enlarged perspective view including a cross section taken along a line Y-Y shown in FIG. 11.

DESCRIPTION OF EMBODIMENTS

Hereinafter, the present invention will be described with reference to the drawings. As shown in (a) and (b) of FIG. 1, FIG. 2, and FIG. 3, a brassiere 10 according to a first embodiment, to which the present invention is applied, is mainly composed of: a pair of right and left cups 20; side panels 40 that directly extend from underarm-side end portions of the cups 20 without a front panel 31, or side panels 40 that extend from underarm-side end portions of a front panel 31 to which the cups 20 are attached; straps 50; the front panel 31 to which the cups 20 are attached; triangular pads 70 that are each sewed to two sides 70*b* and 70*c* of a sternum-side triangular part S on the inner face of each cup 20; and a coupling tape 30 that is sewed to a lower side 20*p* of the cups 20 to couple the cups 20 together. Of course, the front panel 31 can be included in the side panels 40 to provide the side panels 40 extending from both underarm portions of the cups 20.

Each cup 20 is a cup-shaped member covering a breast B, and is composed of: a cup body 20*h*, and an exterior cloth 11 that covers both front and rear faces of the cup body 20*h* according to need. The cup body 20*h* is formed as follows. For example, a sheet-shaped foamed urethane textile which is obtained at a predetermined expansion ratio and has a predetermined thickness, on a surface of which a thin protective cloth is adhered, is molded into a cup shape and cut into a predetermined cup shape. There are various types of foamed textiles such as those having different expansion ratios, i.e., different hardnesses, and those having a large number of air holes (not shown) perforated therein at predetermined intervals. A suitable foamed textile is selected according to the application.

The cup body 20*h* shown in FIG. 3 is formed of one sheet. An upper side 20*d* of the cup body 20*h* sharply rises while curving upward from a stomach part 20*a* at which the right and left cups 20 abut, and greatly curves from a point, in the upper side 20*d*, about ⅓ (⅖ to ⅗) upward from a lower end of the stomach part 20*a* (a portion corresponding to this range is referred to as a rising portion 28), and then extends diagonally upward to reach an end 20*e*. In other words, in this case, in the cup body 20*h*, the radius of the portion that exceeds the point of about ⅓ and reaches the end 20*e* is set to be greater than the radius of the rising portion 28 that is from the lower end of the stomach part 20*a* to the point of about ⅓.

A lower side 20*p* of the cup body 20*h* extends substantially horizontally up to a point about ⅓ (⅖ to ⅗) from the lower end of the stomach part 20*a* (a portion corresponding to this range is referred to as a horizontal edge portion 29), and curves upward from the horizontal edge portion 29 to reach an end 20*q*. When the cup body 20*h* is formed by molding, the substantially triangular part S surrounded by the rising portion 28 and the horizontal edge portion 29 is formed to be thicker than a remaining part T (i.e., a part other than the substantially triangular part S) of the cup 20, except the cases shown in FIGS. 7 to 9 described later. In FIG. 3, the length of the horizontal edge portion 29 is slightly larger than the length of the rising portion 28, although the present invention is not limited thereto.

In this case, regarding change in thickness of the substantially triangular part S, the substantially triangular part S is formed so that, on the inner face of the cup body 20*h*, the thickness thereof gradually increases from the rising portion 28, the horizontal edge portion 29, and a boundary t with the remaining part T toward a center portion of the substantially triangular part S. Therefore, the outer surface of the cup body 20*h* is formed to be a smooth projecting spherical surface having no unnatural lines such as joint lines and steps. It is noted that the shape of the boundary t may be a linear shape, or an arc shape in which the thick portion slightly swells toward the remaining part T side, or a shape in which the thick portion is slightly recessed toward the stomach part 20*a* side.

In the illustrated embodiment, the boundary t between the substantially triangular part S and the remaining part T, which connects an edge P1 of the rising portion 28 to an edge P2 of the horizontal edge portion 29, is formed in a linear shape or a shape slightly curved toward the remaining part T side. However, the present invention is not limited thereto, and the boundary t may be curved toward the stomach part 20*a* side, although not illustrated. If the cup 20 is required to have air permeability, a foamed textile having air holes (not shown) penetrating therethrough from the surface to the rear surface or a foamed textile having open cells may be used.

In the cup body 20*h* formed as described above, since the compression rate of the substantially triangular part S by molding is smaller than that of the remaining part T, stretchability and flexibility remain in the substantially triangular part S. However, the remaining part T outside the substantially triangular part S is greatly compressed, and therefore is harder and less stretchable than the substantially triangular part S. Accordingly, in (b) of FIG. 1, one end of each strap 50 is attached to a portion between the end 20*e* of the upper side 20*d* and the end 20*q* of the lower side 20*p*. In (a) of FIG. 1, one end of each strap 50 is attached to an upper end portion of the front panel 31.

In the cup body 20*h*, as shown in FIG. 3 and FIG. 5, the compression rate of the substantially triangular part S may be smaller than that of the remaining part T. However, as shown in FIGS. 6 to 9, a triangle equivalent part 20*h*1 corresponding to the substantially triangular part S may have the same thickness as the remaining part T, and a separately prepared body pad 20*h*2 may be integrated with the triangle equivalent part 20*h*1 by thermal bonding during molding, pasting, or sewing over the entire periphery thereof. Alternatively, two sides of the body pad 20*h*2 may be thermally bonded, or pasted, or sewed to two sides (the rising portion 28 and the horizontal edge portion 29) of the triangle equivalent part 20*h*1, respectively. In this case, the remaining one side of the triangle equivalent part 20*h*1 is opened and a double-pad structure including the body pad 20*h*2 and the inner-side triangular pad 70 is formed, although not illustrated.

In the embodiment shown in (a) of FIG. 1, the exterior cloth 11 is attached to the surface of each cup body 20*h* as described above, and the coupling tape 30 and the front panel 31 are disposed over the entire lower side 20*p* of the cups 20, i.e., from the horizontal edge portions 29 to the side edges 25 of the cups 20, and these parts are sewed along the coupling tape 30. Further, a decorative belt 12 is disposed so as to cover the lower side portions of the cups 20. Lace textiles 23 are disposed so as to cover the both side surfaces of the cups 20, the both sides of the decorative belt 12, and the front panel 31, and are sewed to these portions along the coupling tape 30. For the exterior cloth 11, a solid textile or a decorative textile (especially for the outer surface) may be used. The exterior cloth 11 may be omitted. For the decorative belt 12, a spandex fabric having stretchability in the longitudinal direction is used.

In the case of (b) of FIG. 1, the front panel 31 is not provided, and the cups 20 are directly coupled together by the coupling tape 30 and the stomach parts 20*a* of the cups 20. Except the above points, the example shown in (b) of FIG. 1 is identical to the example shown in (a) of FIG. 1.

The triangular pad 70 may be attached to a pocket 80 provided on the inner face side of the cup body 20*h* as shown in FIG. 3, or may be singly attached to the cup body 20*h* without providing a pocket 80 as shown in FIG. 5. When the triangular pad 70 is singly attached, the triangular pad 70 may be attached not by sewing but by means of hook and loop fasteners 71*a* and 71*b* as shown in FIG. 10. Further, the triangular pad 70 may be formed in a hollow bag shape as shown in FIG. 9. In this embodiment, the case of FIG. 3 will be described.

The pocket 80 is a thin cloth provided over almost the entire surface of the cup body 20*h*, and is sewed to almost the entire upper side 20*d* of the cup body 20*h* and to the most part (the entirety of the horizontal edge portion 29 and a part of the side edge 25 near the horizontal edge portion 29) of the lower side 20*p* of the cup body 20*h*. An opening 80*a* is provided from near the end 20*e* of the upper side 20*d* to an upper portion of the side edge 25 including the end 20*q* of the lower side 20*p*. If necessary, the user can insert a separately prepared auxiliary pad into the pocket 80 from the opening 80*a* to make the breast B appear more voluminous.

The triangular pad 70 is formed similarly to the cup body 20*h* as follows. For example, a sheet-shaped foamed urethane textile which is obtained at a predetermined expansion ratio and has a predetermined thickness, on a surface of which a thin protective cloth is adhered, is cut out into a predetermined shape and is molded into the same size as (or a similar shape to) the substantially triangular part S of the cup body 20*h*. Of course, a manufacturer may simply cut the sheet-shaped foamed urethane textile into the same size as (or a similar shape to) the substantially triangular part S of the cup body 20*h* to use the cut textile piece as the triangular pad 70. Although the triangular pad 70 is usually made of a soft foamed resin, the triangular pad 70 may have a bag shape obtained by welding the peripheries of two soft sheets, and filling the inside with air (FIG. 9).

Thus formed triangular pad 70 is first sewed to a portion, of the pocket 80, corresponding to the triangular part S. Next, the triangular pad 70 sewed to the pocket 80 is disposed so that the triangular pad 70 is placed on the triangular part S between the rising portion 28 and the horizontal edge portion 29 of the cup body 20*h*. Then, the triangular pad 70 is sewed to the cup body 20*h* together with the pocket 80. Thus, attachment sides 70*b* and 70*c* of the triangular pad 70 are sewed to the rising portion 28 and the horizontal edge portion 29, respectively, of the cup body 20*h* that form a V shape. A remaining one side (open side 70*a*) that is present between the attachment sides 70*b* and 70*c* and is not sewed is formed in a linear line shape or an arc shape slightly swelling outward, similarly to the boundary t between the thickly formed triangular part S and the thin remaining part T of the cup body 20*h* (in the case of FIG. 7, the triangular part S has the same thickness as the remaining part T). However, in the triangular pad 70, it is not preferable to form the open side 70*a* in an arc shape recessed inward. The periphery of the triangular pad 70 is compressed by molding (or by sewing the entire periphery of the triangle) so that the thickness of the triangular pad 70 gradually increases toward the center. Therefore, the triangular pad 70 is formed like a cushion. The foamed textile for the triangular pad 70 may be basically the same as that for the cup body 20*h*, but may be different from that for the cup body 20*h*. For example, a foamed textile having a higher expansion ratio (a foamed textile being softer) than the cup body 20*h* may be used. Conversely, a foamed textile having a lower expansion ratio (a foamed textile being harder) than the cup body 20*h* may be used.

The coupling tape 30 is a part for coupling the pair of right and left cups 20 together. In the present embodiment, as the coupling tape 30, a non-stretch coupling tape is adopted that is wireless (no wire bone is inserted in the lower side 20*p* of the cup 20) and is a thick napped material in a tape shape. This coupling tape 30 and the front panel 31 are sewed or adhered to the entire lower side 20*p* extending from the lower end of the stomach part 20*a* of each cup 20 to the end 20*q* of the lower side 20*p* of each cup 20, whereby the cups 20 are coupled together (refer to (a) of FIG. 1). In the case shown in (b) of FIG. 1, the front panel 31 is not provided, and the cups 20 are coupled together by at least the coupling tape 30.

In the present embodiment shown in (a) and (b) of FIG. 1, the stomach parts 20*a* of the right and left cups 20, at which the rising portions 28 of the cups 20 abut, are also sewed to be integrated. Parts (upper sides 20*d*) above the stomach parts 20*a* are free. Specific examples of the napped material used for the coupling tape 30 include velveteen, cotton flannel, velvet, and the like. The reason why such a thick napped material is adopted as the coupling tape 30 is to increase the strength of the base material of the coupling tape 30 itself so as to reliably support the breasts B at the lower sides of the cups 20 although the coupling tape 30 is wireless, and to enhance the wearing feeling when the coupling tape 30 touches the skin.

Each of the side panels 40 is a band-shaped member made of a fiber material having strong stretchability, such as spandex. To a distal end portion of one of the side panels 40, eyes 26 are attached (refer to FIG. 1). To a distal end portion of the other side panel 40, hooks 27 to be engaged with the eyes 26 are attached (refer to FIG. 2). In (a) of FIG. 1, a slim stretch belt 41 having strong stretchability in its longitudinal direction is sewed to the lower side portions of the both side panels 40 and the front panel 31 over the entire length thereof. On the other hand, in (b) of FIG. 1, the stretch belt 41 is sewed along the horizontal edge portions 29 of the right and left cups 20.

The straps 50 are parts for preventing positional shift of the cups 20 and for lifting and holding the breasts B accommodated in the cups 20. One end of each strap 50 is connected to the upper end of the front panel 31 ((a) of FIG. 1) or to the end 20*e* of the upper side 20*d* of the corresponding cup 20 ((b) of FIG. 1), while the other end thereof is connected to an upper edge of the corresponding side panel 40 that is located on the back side.

Hereinafter, the function of the triangular pad 70 will be described. The substantially triangular part S of each cup 20 is formed to be thicker toward the center thereof as described above, except in FIGS. 7 and 8. The triangular pad 70 is also formed to be thicker toward the center thereof, just like a cushion, and the attachment sides 70*b* and 70*c* thereof are fitted (sewed) to the rising portion 28 and the horizontal edge portion 29 of the cup 20, respectively, while the remaining one side 70*a* is opened so as to be separated from the inner face of the cup 20. As a result, the open side 70*a* and its adjacent portion, which are shown by a lattice pattern in FIG. 4, are separated from the cup body 20*h* and swell outward as shown in FIG. 3. This swelling portion has repulsive force in the direction toward the breast (i.e., the direction separating from the cup body 20*h*). In other words, since the open side 70*a* of the triangular pad 70 is not sewed, the fitted and integrated periphery of the triangular pad 70 applies, to the center portion thereof, the repulsive force in the direction separating from the inner face of the cup 20. Then, the swelling center portion of the triangular pad 70, which is bent toward the inner face of the cup 20 when the user wares the brassiere 10, is pushed against the swelling center portion of the substantially triangular part S of the cup 20 and rebounds, and acts to push back the triangular pad 70 toward the breast B.

Next, the relationship between the triangular pad 70 and the triangular part S of the cup body 20*h* will be described. Basically, the triangular pad 70 and the triangular part S of the cup body 20*h* have the same shape, and the open side 70*a* of the triangular pad 70 and the boundary t of the triangular part S are linear in shape. Therefore, when the user wears the brassiere 10, the triangular pad 70 overlaps with the cup body 20*h* with some separation space D therebetween although it depends on the state of wearing. In the case where the open side 70*a* of the triangular pad 70 curves outward so as to project beyond the boundary t of the triangular part S, the open side 70*a* covers the boundary t of the triangular part S and gently fits the breast B.

Next, the function of the triangular pad 70 when the user wears the brassiere 10 of the present invention will be described with reference to FIGS. 11 to 13. What is important here is as follows. The brassiere 10 of the present invention is intended to form more voluminous breasts B and a beautiful decollete, and is very effective particularly when the volume of the breasts B including flab is insufficient. When the user wears the brassiere 10, tension in the horizontal direction due to tightening by the side panels 40 and tension in the upward direction due to pulling-up by the straps 50 act on the coupling tape 30. Thereby, tensions in the same directions as above act on the cups 20 sewed to the coupling tape 30. That is, due to pulling-up by the straps 50, tension to pull up the breasts B acts, around the stomach part 20*a*, on the cups 20 at lower edge portions K shown by lattice patterns. Simultaneously, due to the tension in the horizontal direction caused by tightening by the side panels 40, tension in the tightening direction is applied to the cups 20 so that the cups 20 lightly press the breasts B.

When the user wares the brassiere 10, the user gathers not only the breasts B but also flab from the underarms to the back, toward the sternum side of the cups 20 to accommodate the breasts B and the flab in the cups 20, thereby increasing the volume of the breasts B as much as possible. As shown in FIG. 12, the breasts B accommodated in the cups 20 are lightly pressed by the cups 20 to which the tension in the tightening direction is applied as described above. Since the triangular parts S of the cups 20 press the triangular pad 70 from the upper side, the triangular pads 70 fill an area from the stomach to the sternum of the wearer having little breast volume, and part of a slight volume on the sternum side of each breast B contacting the triangular pad 70 is pushed outward by the repulsive force from the triangular pad 70.

In particular, the above-described triangular part S is formed so that its thickness increases toward the center portion thereof. Similarly to the triangular part S, the triangular pad 70 is formed like a cushion so that its thickness increases toward the center portion thereof, with the two sides 70*b* and 70*c* thereof being integrally sewed to the rising portion 28 and the horizontal edge portion 29 of each cup 20, respectively, and the remaining one side being the open side 70*a*. Therefore, the thick portions of the triangular part S and the triangular pad 70 push against each other, whereby the triangular pad 70, particularly the center portion of the open side 70*a* indicated by hatched lines (FIG. 12), is pushed out in the direction separating from the inner face of the cup 20 and strongly pressed against the sternum-side portion of the breast B. Thereby, the sternum-side portion of the breast B is pushed outward.

The pushed-out portion joins the portion accommodated in the cup 20 to increase the volume of the breast B, and the lower edge of the breast B is lifted by the function of the coupling tape 30 of the cup 20, and then the breast B is pushed toward the sternum side by the pulling-up tension of the strap 50. The breasts B, which have been effectively pushed out to increase the volume thereof as described above, are pulled up by the straps 50 at the side portions of the cups 20 with the stomach part 20*a* in the center, and the breasts B the volume of which is thus increased are pushed in the direction from the underarms toward the stomach side to create a beautiful decollete in the neckline area. At this time, since a conventional wire bone is not inserted in the coupling tape 30, the brassiere 10 does not bite into the skin but softly fits the skin without making the user feel discomfort.

Since the pockets 80 are provided in the first embodiment, the user can further increase the volume of the breasts B by inserting the separately prepared auxiliary pads into pockets 80 from the opening 80*a*.

A second embodiment is shown in FIGS. 4 and 5. In this case, no pocket 80 is provided, and the triangular pad 70 is directly sewed to the corresponding portion of the cup body 20*h* and used. The function and effect are the same as those of the first embodiment.

FIG. 6 shows a modification of the first embodiment. In this modification, the cup body 20*h* is composed of the triangle equivalent part 20*h*1, the remaining part T continued to the triangle equivalent part 20*h*1, and the separately provided body pad 20*h*2 as described above, and the triangle equivalent part 20*h*1 and the remaining part T have the same thickness. Since the body pad 20*h*2 has the same function as the triangular part S of the first embodiment, the body pad 20*h*2 is formed like a cushion and adhered or sewed to the triangle equivalent part 20*h*1, or formed by molding to be integrated with the triangle equivalent part 20*h*1. Other aspects are the same as those of the first embodiment. The body pad 20*h*2 may be adhered at the entire surface or sewed at the entire periphery as described above, but two sides of the body pad 20*h*2 may be fitted to the rising portion 28 and the horizontal edge portion 29, respectively, of the cup 20, and remaining one side may be opened. In this case, further increase in volume of the breasts B can be achieved by the double effects of the body pad 20*h*2 and the triangular pad 70.

FIG. 7 shows a third embodiment. In this third embodiment, the cup body 20*h* is molded so as to have a uniform thickness throughout, and the triangular pad 70 is disposed on the triangular part S (or the triangle equivalent part 20*h*1 in FIG. 6) of the cup body 20*h* and sewed at the two sides thereof, similarly to the first embodiment. In this case, since the triangular part S of the cup body 20*h* is not thick, the thickness of the triangular pad 70 is increased instead. The function and effect of the third embodiment are the same as those of the first embodiment.

FIG. 8 shows a modification of the third embodiment. In this modification, the cup body 20*h* and the triangular pad 70 are molded so as to have the same uniform thickness throughout, and the triangular pad 70 having the same thickness as the cup body 20*h* is disposed on the triangle equivalent part 20*h*1 of the cup body 20*h* and sewed at the two sides thereof, similarly to the first embodiment. The thin triangular pad 70 warps toward the breast B as described above due to a reaction force of the cup 20 hemispherically swelling outward and the sewing. However, since the cup body 20*h* and the triangular pad 70 have the same small thickness throughout, the effect of increasing the volume of the breasts B is inferior to the case of FIG. 7. The user may insert the auxiliary pad between the cup body 20*h* and the triangular pad 70 to compensate for the inferiority.

FIG. 9 shows the case where the triangular pad 70 is formed in a hollow bag shape. The wearing manner and the achieved effect are the same as those of the triangular pad 70 made from sponge.

FIG. 10 shows a fourth embodiment. This fourth embodiment is different from the first embodiment in that the triangular pad 70 is attachable and detachable by means of the hook and loop fasteners 71*a* and 71*b*. The hook (or loop) fastener 71*b* is attached along the rising portion 28 of the cup 20 and the horizontal edge portion 29 of the lower side 20*p* of the cup 20, while the loop (or hook) fastener 71*a* is attached to the two sides of the triangular pad 70 that correspond to the rising portion 28 and the horizontal edge portion 29. By utilizing the hook and loop fasteners 71*a* and 71*b*, multiple types of triangular pads 70 can be provided and an optimum one can be selected to be used. Other aspects and the functional effects are the same as those of the first embodiment.

In the embodiments shown in FIGS. 6 to 10, the pocket 80 is not illustrated in these figures. However, also in these embodiments, the triangular pad 70 may be attached to the pocket 80 as described in the first embodiment. In each figure, an arrow F conceptually indicates a direction in which force is applied as described above.

REFERENCE SIGNS LIST

10 brassiere
11 exterior cloth
12 decorative belt
20 cup
20*a* stomach part
20*d* upper side of cup
20*e* end of upper side
20*h* cup body
20*h*1 triangle equivalent part
20*h*2 body pad
20*p* lower side of cup
20*q* end of lower side
23 lace textile
25 side edge of cup
26 eye
27 hook
28 rising portion of cup
29 horizontal edge portion at lower side of cup
30 coupling tape
31 front panel
40 side panel
41 stretch belt
50 strap
70 triangular pad
70*a* open side (remaining one side)
70*b*, 70*c* attachment side
71*a*, 71*b* hook and loop fastener
80 pocket
80*a* opening
B breast
K lower edge portion
D separation space
F direction in which swelling force is applied
P1 edge of rising portion
P2 edge of horizontal portion
S triangular part
T remaining part
t boundary

The invention claimed is:

1. A wireless brassiere comprising:

a pair of right and left cups adapted to cover breasts of a wearer, the right and left cups abut at a center part of the brassiere and each includes an upper side and a lower side;

a coupling tape sewn at the lower side of each of the right and left cups, wherein the coupling tape couples the lower side of the right cup and the lower side of the left cup;

side panels extending from underarm portions of the respective cups; and straps provided from upper edges of the respective cups to the side panels, wherein each of the right and left cups includes a cup body and a triangular pad, the cup body including an inner face and having an upper side extending from the center part to an upper side end and a lower side extending from the center part to a lower side end, the cup body of the each of the right and left cups including a first part and a second part, the first part being a triangular part having three sides respectively defined by a rising portion of the upper side of the cup body, a horizontal edge portion of the lower side of the cup body, and a boundary, the rising portion curving upward from the center part at which the right and left cups abut and extending to an upper side point disposed on the upper side of the cup body at a distance between 2/5 to 3/7 of a length of the upper side of the cup body from the center part, the upper side point being an end of the rising portion, the horizontal edge portion extending in a horizontal direction from the center part to a lower side point disposed on the lower side of the cup body at a distance between 2/5 to 3/7 of a length of the lower side of the cup body from the center part, the lower side point being an end of the horizontal edge portion, and the boundary being a line connecting the upper side point and the lower side point and dividing the cup body into the first part and the second part, the second part being a remaining part of the cup body other than the first part, the second part being surrounded by the boundary, a portion of the upper side extending from the upper side point to the upper side end, and a portion of the lower side extending from the lower side point to the lower side end, a thickness of the first part is greater than a thickness of the second part, the triangular pad has a same shape and area as the first part of the cup body and the triangular pad extends over the first part of the cup body, whereby the first part and the triangular pad form a two-layer structure, and wherein a thickness of the triangular pad increases toward a center of the triangular pad and two sides of the triangular pad are fastened to the rising portion and the horizontal edge portion of the cup body, respectively, while a remaining one side of the triangular pad that extends from the upper side point to the lower side point is detached from the cup body so that the remaining one side is separated from the inner face of the cup body.

2. A wireless brassiere comprising:

a pair of right and left cups adapted to cover breasts of a wearer, the right and left cups abut at a center part of the brassiere and each includes an upper side and a lower side;

a front panel to which the cups are attached;

side panels extending from underarm portions of the front panel; and straps provided from upper edges of the respective cups to the side panels, wherein each of the right and left cups includes a cup body and a triangular pad, the cup body including an inner face and having an upper side extending from the center part to an upper side end and a lower side extending from the center part to a lower side end, the cup body of the each of the right and left cups including a first part and a second part, the first part being a triangular part having three sides respectively defined by a rising portion of the upper side of the cup body, a horizontal edge portion of the lower side of the cup body, and a boundary, the rising portion curving upward from the center part at which the right and left cups abut and extending to an upper side point disposed at a distance between 2/5 to 3/7 of a length of the upper side of the cup body from the center part, the upper side point being an end of the rising portion, the horizontal edge portion extending in a horizontal direction from the center part to a lower side point disposed at a distance between 2/5 to 3/7 of a length of the lower side of the cup body from the center part, the lower side point being an end of the horizontal edge portion, and the boundary being a line connecting the upper side point and the lower side point and dividing the cup body into the first part and the second part, the second part being a remaining part of the cup body other than the first part, the second part being surrounded by the boundary, a portion of the upper side extending from the upper side point to the upper side end, and a portion of the lower side extending from the lower side point to the lower side end, a thickness of the first part is greater than a thickness of the second part, and the triangular pad has a same shape and area as the first part of the cup body and the triangular pad extends over the first part of the cup body, whereby the first part and the triangular pad form a two-layer structure, and wherein a thickness of the triangular pad increases toward a center of the triangular pad and two sides of the triangular pad are fastened to the rising portion and the horizontal edge portion of the cup body, respectively, while a remaining one side of the triangular pad that extends from the upper side point to the lower side point is detached from the cup body so that the remaining one side is separated from the inner face of the cup body.

* * * * *